US006007214A

United States Patent [19]

Shiao

[11] Patent Number: 6,007,214

[45] Date of Patent: Dec. 28, 1999

[54] ILLUMINATING TOOL

[76] Inventor: Hsuan-Sen Shiao, No. 15-1, Lane 369, Min-Chuan Rd., Taichung City, Taiwan

[21] Appl. No.: 09/143,378

[22] Filed: Aug. 28, 1998

[51] Int. Cl.[6] ..... F21L 11/00

[52] U.S. Cl. ..... 362/120; 362/109; 362/119

[58] Field of Search ..... 362/119, 120, 362/118, 109, 139, 418, 419

[56] References Cited

U.S. PATENT DOCUMENTS

| | | | |
|---|---|---|---|
| 2,235,109 | 3/1941 | Morey | 362/109 |
| 4,429,350 | 1/1984 | Guthrie | 362/120 |
| 5,172,974 | 12/1992 | Riban | 362/109 |
| 5,203,622 | 4/1993 | Sottile | 362/109 |
| 5,381,319 | 1/1995 | Shiao | 362/109 X |

*Primary Examiner*—Laura K. Tso
*Attorney, Agent, or Firm*—Foley & Lardner

[57] ABSTRACT

An illuminating tool includes a flexible core with head and tail end portions, and a pair of wires exposed from the end portions to form central and peripheral head contacts and central and peripheral tail contacts. A first socket member has a first neck end mounted on the tail end portion, and a first socket portion extending axially therefrom to form a proximate inner engaging wall relative to the tail end portion to enclose the central tail contact and a distal inner engaging wall connected conductively to the peripheral tail contact. A barrel housing defines a first axis and accommodates a battery. The barrel housing has a front end, an intermediate wall and a rear end in the form of a mounting seat. A switch member is operable externally along the first axis between a switch-on position, where electrical connection is established between a second electrode of the battery and the barrel housing, and a switch-off position. A bulb is received in a bulb seat that permits plugging and gripping of the head end portion of the flexible core to establish electrical connection between the bulb and the conductive wires.

4 Claims, 4 Drawing Sheets

ILLUMINATING TOOL

BACKGROUND OF THE INVENTION

1. Field of the Invention

The invention relates to an illuminating tool, more particularly to an illuminating tool which has a flexible core.

2. Description of the Related Art

Referring to FIG. 1, a conventional illuminating tool is shown to include a conductive barrel housing 4, a battery 7, a bulb seat 5, a bulb unit 8, a transparent sleeve 6, and a writing device. The barrel housing 4 defines an axis, and has a front end 41, a rear end 42 extending axially from the front end 41 to form an internally threaded portion 44, and a intermediate wall 43 extending axially between the front and rear ends 41, 42 to accommodate the battery 7 therein. The writing device includes a neck portion 2 inserted threadedly into the threaded portion 44, a writing nib 3 disposed within the rear end 42, and a retractable hand grip 1 exposed axially and outwardly from the rear end 42 of the barrel housing 4. The bulb seat 5 has a distal socket portion 51 relative to the front end 41 and formed with a conductive inner grip wall, and a proximate socket portion 52 formed with a conductive inner grip wall for coupling with the front end 41 of the barrel housing 4. The bulb 8 is received in the distal socket portion 51, and has a base with a ring contact in electrical contact with the inner grip wall thereof, and a tip contact that extends into the proximate socket portion 52 to engage a first terminal of the battery 7 when the bulb seat 5 is coupled to the barrel housing 4. A conductive stem 55 is disposed movably in the barrel housing 4 adjacent to the rear end 42 in such a manner that tightening action of the neck portion 2 relative to the threaded portion 44 enables the stem 55 to establish electrical connection between a second terminal of the battery 7 and the barrel housing 4. The transparent sleeve 6 has a front end fixed with a magnet 9 and a second end detachably mounted on the distal socket portion 51.

The aforesaid illuminating tool is useful in many ways, such as in picking up a fastener from a bottom of a machine body by the use of the magnet 9, for writing on a sheet of paper when the writing device is removed from the rear end 42 of the barrel housing 4, or for extending the retractable handle grip so as to enable the magnet 9 to reach a long distance. However, the light rays emitted by the bulb 8 cannot be converted to other directions that deviate from an axis of the barrel housing 4, thereby limiting the useful of the illuminating tool.

SUMMARY OF THE INVENTION

The object of this invention to provide an illuminating tool which is clear of the aforementioned drawbacks that are generally associated with the conventional illuminating tool.

Accordingly, the illuminating tool of this invention includes a flexible core with head and tail end portions, a first socket member, a battery, a conductive barrel housing, a switch member, a bulb seat, and an electric bulb. The flexible core has a pair of electrically conductive wires that extend axially therethrough and outwardly of the head and tail end portions to respectively form a central head contact and a peripheral head contact radially spaced from the former, and a central tail contact and a peripheral tail contact radially spaced from the former. The central and peripheral head contacts are exposed from the head end portion. The central and peripheral tail contacts are exposed from the tail end portion. The first socket member has a first neck end mounted on the tail end portion, and a first socket portion that extends axially and circumferentially from the first neck end to form a proximate inner engaging wall relative to the tail end portion to enclose the central tail contact and a distal inner engaging wall connected conductively to the peripheral tail contact. The battery has first and second electrodes. The conductive barrel housing defines a first axis and accommodates the battery. The barrel housing has a front end engaging the distal inner engaging wall to bring the first electrode into electrical contact with the central tail contact, an intermediate circumferential wall that extends circumferentially along the first axis from the front end to enclose the battery, and a rear end that extends circumferentially along the first axis from the intermediate circumferential wall to form an annular mounting seat. The switch member is mounted on the mounting seat, and has a press button disposed outwardly of the rear end so as to be operated externally, and an actuating stem which extends from the press button in a transverse direction relative the first axis and interiorly of the rear end. The actuating stem is movable by the press button along the transverse direction between a switch-on position, where the actuating stem establishes an electrical connection between the second electrode and the conductive barrel housing, and a switch-off position where the actuating stem disconnects the second electrode from the conductive barrel housing. The bulb seat includes a distal socket portion with an electrically conductive distal inner grip wall, and a proximate socket portion with an electrically conductive proximate inner grip wall. The bulb is received in the distal socket portion, and has a bulb base with a ring contact in electrical contact with the distal inner grip wall, and a tip contact that extends into the proximate inner grip wall. The proximate inner grip wall is of such a dimension that when the head end portion is plugged and gripped in the proximate inner grip wall, the central head contact and the peripheral head contact establish electrical connection with the tip contact and the proximate inner grip wall, respectively.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
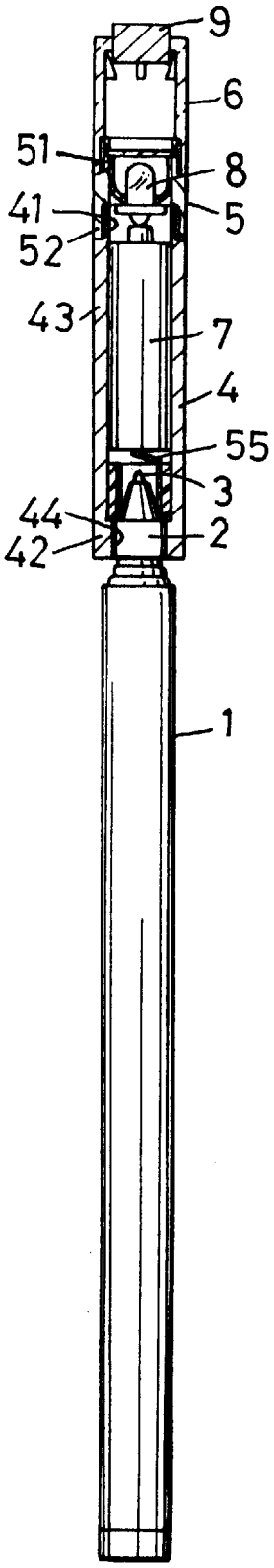
FIG.1 PRIOR ART
FIG. 1 is a fragmentary, partly sectional view of a conventional illuminating tool.
Figure 2:
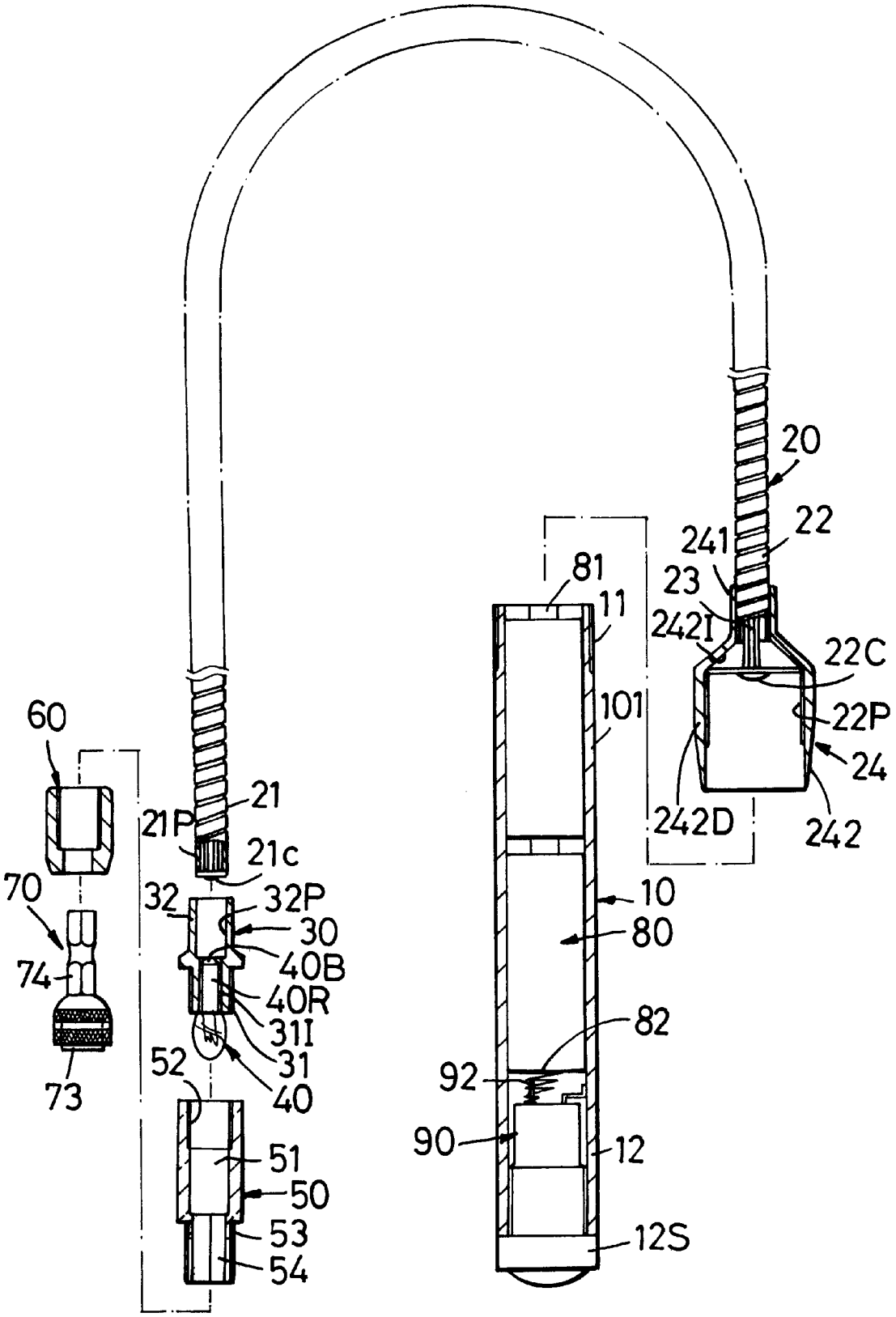
FIG. 2 is an exploded, partly sectional view of the preferred embodiment of an illuminating tool of this invention.
Figure 3:
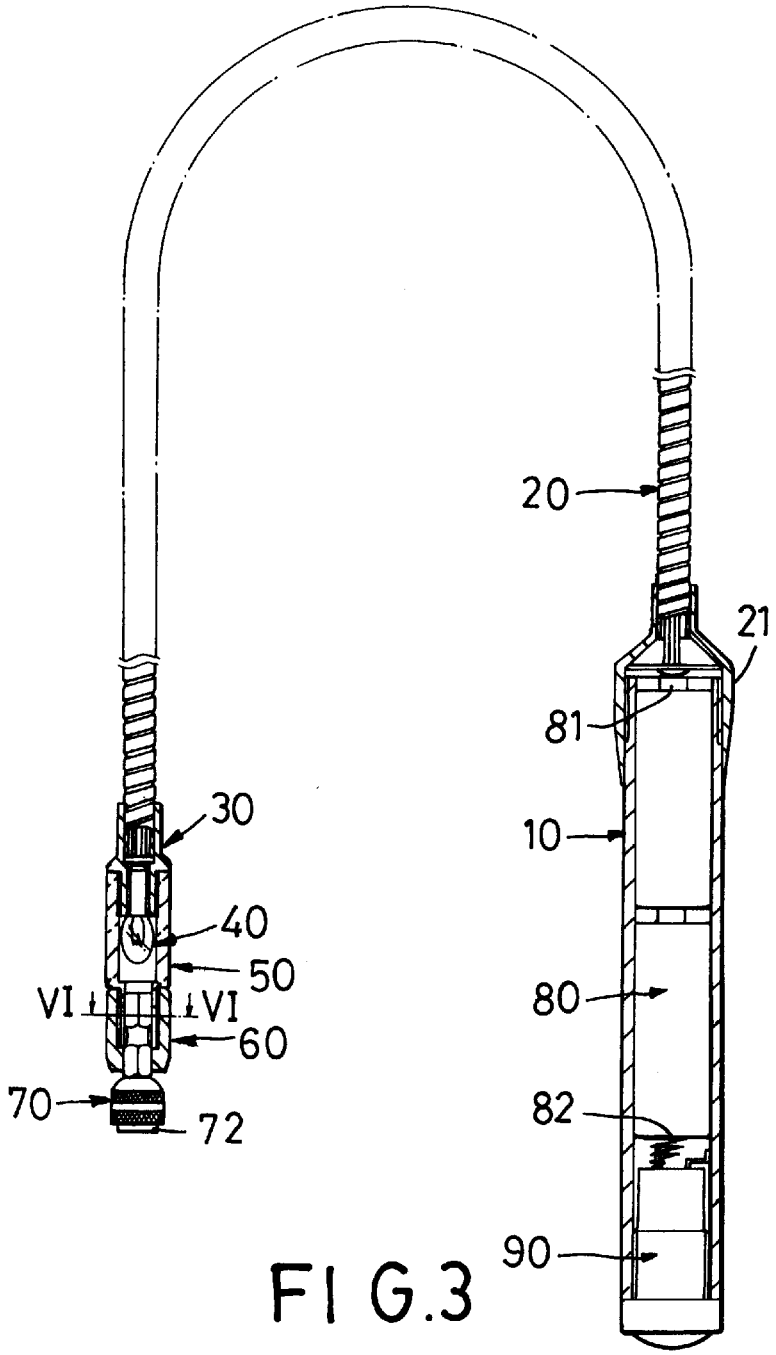
FIG. 3 is an assembled, partly sectional view of the preferred embodiment.
Figure 4:
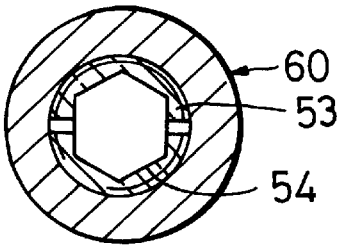
FIG. 4 is a cross sectional view of the preferred embodiment taken along line IV—IV in FIG. 3.

Referring to FIGS. 2, 3 and 4, the preferred embodiment of an illuminating tool according to this invention is shown to include a flexible core 20 with head and tail end portions 21, 22, a first socket member 24, a battery 80, a conductive barrel housing 10, a switch member 90, a bulb seat 30, and an electric bulb 40.

As illustrated, the flexible core 20 has a pair of electrically conductive wires 23 that extend axially therethrough and outwardly of the head and tail end portions 21, 22 to respectively form a central head contact 21C and a peripheral head contact 21P radially spaced from the central head contact 21C, and a central tail contact 22C and a peripheral tail contact 22P radially spaced from central tail contact 22C. The central head contact 21C and the peripheral head contact 21P are exposed outwardly of the head end portion 21.

The central tail contact 22C and the peripheral tail contact 22P are exposed outwardly of the tail end portion 22.

The first socket member 24 has a first neck end 241 mounted on the tail end portion 22, and a first socket portion 242 extending axially and circumferentially from the first neck end 241 to form a proximate inner engaging wall 242I relative to the tail end portion 22 to enclose the central tail contact 22C, and a distal inner engaging wall 242D connected conductively to the peripheral tail contact 22P.

The battery 80 has first and second electrodes 81, 82.

The conductive barrel housing 10 defines a first axis and accommodates the battery 80 therein. The barrel housing 10 has a front end 11 engaging the distal inner engaging wall 242D to bring the first electrode 81 into electrical contact with the central tail contact 22C, an intermediate circumferential wall 101 that extends circumferentially along the first axis from the front end 11 to enclose the battery 80, and a rear end 12 that extends circumferentially along the first axis from the intermediate circumferential wall 101 to form an annular mounting seat 12S.

The switch member 90 is mounted on the mounting seat 12S, and has a press button (not shown) disposed outwardly of the rear end 12 so as to be operated externally, and an actuating stem 92 that extends from the press button interiorly of the rear end 12 along a transverse direction relative to the first axis. The actuating stem 92 is movable by the press button in the the transverse direction between a switch-on position, where the actuating stem 92 establishes an electrical connection between the second electrode 82 and the conductive barrel housing 10, and a switch-off position, where the actuating stem 92 disconnects the second electrode 82 from the conductive barrel housing 10.

The bulb seat 30 includes a distal socket portion 31 with an electrically conductive distal inner grip wall 31I, and a proximate socket portion 32 with an electrically conductive proximate inner grip wall 32P.

The electric bulb 40 is received in the distal socket portion 31, and has a bulb base with a ring contact 40R in electrical contact with the distal inner grip wall 31I, and a tip contact 40B that extends into the proximate inner grip wall 32P. The proximate inner grip wall 32P is of such a dimension that when the head end portion 21 is plugged and gripped in the proximate inner grip wall 32P, the central head contact 21C and the peripheral head contact 21P establish electrical connection with the tip contact 40B and the proximate inner grip wall 32P, respectively.

In this preferred embodiment, the first socket member 24 and the bulb seat 30 are made from a conductive material. The flexible core 20 has an outer conductive sheath, an inner conductive wire 23 and an insulating intermediate sheath disposed inside the outer conductive sheath to enclose the inner conductive wire 23 such that the outer conductive sheath and the inner conductive wire 23 serve as the pair of conductive wires. Accordingly, two opposite ends of the outer conductive sheath serve as the peripheral head and contacts 21P, 22P, respectively.

The preferred embodiment includes a tool holding member 50 which is formed as an integrally molded transparent plastic body and which has a lower grip portion 52 that defines an axis that is of a dimension such that the distal socket portion 31 can be plugged and gripped in the lower grip portion 52. The tool holding member 50 further includes a collet portion 53 disposed distal to the distal socket portion 31 along the axis and adapted to grip a tool therein, and an accommodation chamber 51 interposed between the lower grip portion 52 and the collet portion 53 along the axis so as to receive the electric bulb 40 when the distal socket portion 31 is gripped in the lower grip portion 52.

A ferrule member 60 is disposed to couple with the collet portion 53 so as to tighten the gripping action of the collet portion 53 on the tool.

Preferably, the collet portion 53 defines an inner wall 54 of hexagonal cross section. The preferred embodiment further includes a tool 70 that defines a second axis parallel to the first axis, and that has a shank portion 74 extending in the second axis and of a cross section corresponding to the inner wall 55 of the collet portion 53, and an enlarged magnetic head 73 disposed on one end of the shank portion 74 such that, when the shank portion 74 is inserted into the collet portion 53, the enlarged magnetic head 73 will be exposed exteriorly of the collet portion 53, and such that the shank portion 74 will be gripped by tightening action of the ferrule member 60 on the collet portion 53.

Alternatively, the flexible core 20 includes an outer resilient conductive sleeve and a flexible spine disposed within the resilient conductive sleeve to enclose the conductive wire 23 such that the flexible core 20 can be retained at any angular position relative to the conductive barrel housing 10.

Figure 5:
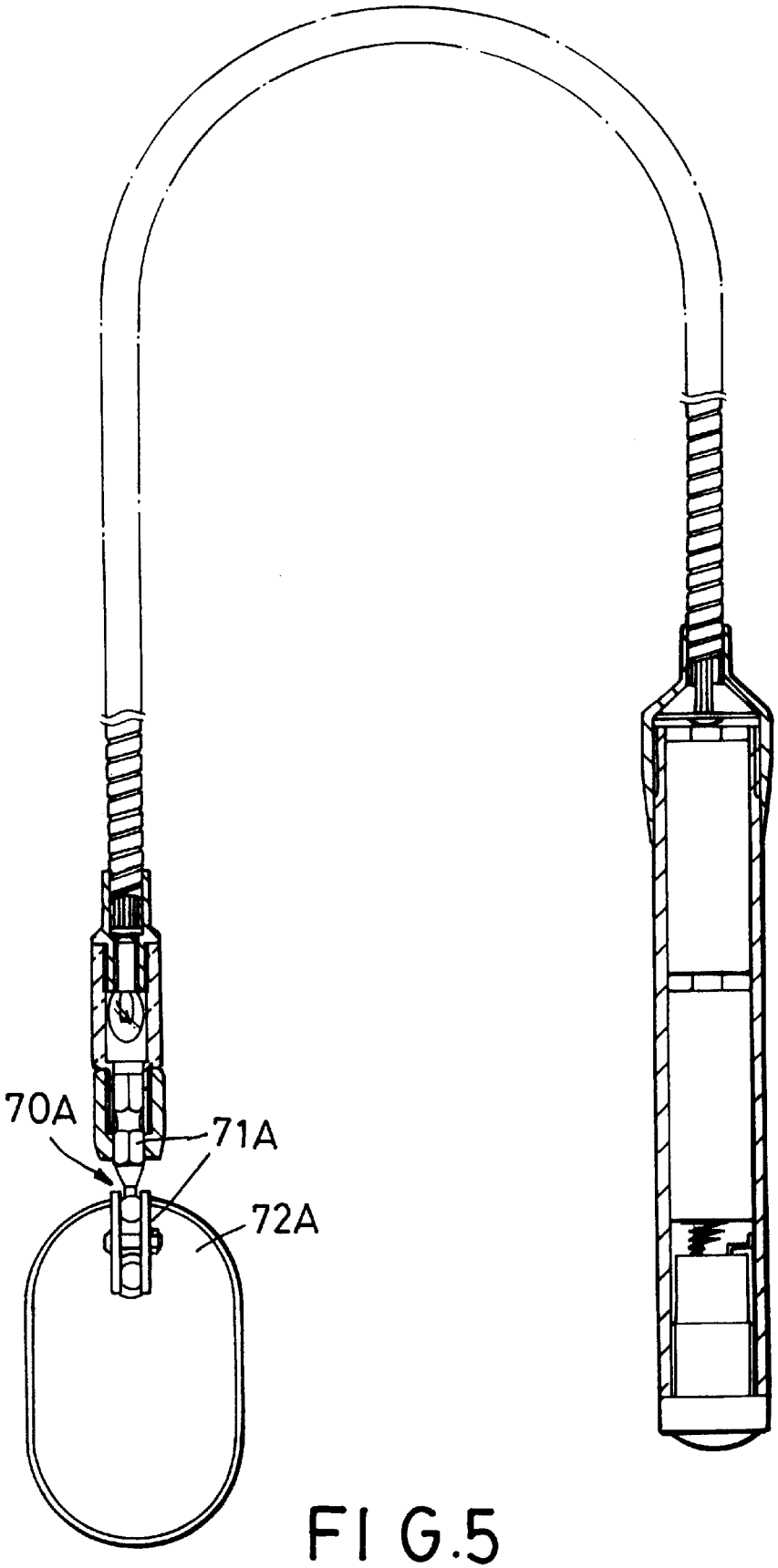
FIG. 5 illustrates a modified illuminating tool of this invention.

Referring to FIG. 5, a modified preferred embodiment of this invention is shown to be similar in construction to the previous embodiment except in that a mirror 72A is mounted adjustably on one end of the shank portion 71A of the tool 70A. The shank portion 71A extends in a second axis parallel to the first axis, and is of a cross section corresponding to the inner wall of the collet portion 53 (see FIG. 2) such that, when the shank portion 71A is inserted into the collet portion 53, the mirror 72A will be exposed exteriorly of the collet portion 53, and such that the shank portion 71A will be gripped by tightening action of the ferrule member 60 (see FIG. 2) on the collet portion 53.

With this invention thus explained, it is apparent that numerous modifications and variations can be made without departing from the scope and spirit of this invention. It is therefore intended that this invention be limited only as indicated in the appended claims.

I claim:

1. An illuminating tool, comprising:

a flexible core with head and tail end portions, said flexible core having a pair of electrically conductive wires that extends axially therethrough and outwardly of said head and tail end portions to respectively form a central head contact and a peripheral head contact radially spaced from said central head contact, both of which are exposed from said head end portion, and a central tail contact and a peripheral tail contact radially spaced from central tail contact, both of which are exposed from said tail end portion, a first socket member having a first neck end mounted on said tail end portion, and a first socket portion extending axially and circumferentially from said first neck end to form a proximate inner engaging wall relative to said tail end portion to enclose said central tail contact, and a distal inner engaging wall connected conductively to said peripheral tail contact;

at least one battery with first and second electrodes;

an electrically conductive barrel housing defining a first axis and accommodating said battery, said barrel housing having:

a front end engaging said distal inner engaging wall to bring said first electrode into electrical contact with said central tail contact;

an intermediate circumferential wall extending circumferentially along said first axis from said front end to enclose said battery; and a rear end extending circumferentially along said first axis from said intermediate circumferential wall to form an annular mounting seat;

a switch member mounted on said mounting seat, and having a press button disposed outwardly of said rear end and so as to be operated externally, and an actuating stem extending from press button in a transverse direction relative to said first axis and interiorly of said rear end, said actuating stem movable by said press button in said transverse direction between a switch-on position, where said actuating stem establishes an electrical connection between said second electrode and said barrel housing, and a switch-off position where said actuating stem disconnects said second electrode and said barrel housing;

a bulb seat including a distal socket portion with an electrically conductive distal inner grip wall, and a proximate socket portion with an electrically conductive proximate inner grip wall;

an electric bulb received in said distal socket portion, and having a bulb base with a ring contact in electrical contact with said distal inner grip wall and a tip contact extending into said proximate inner grip wall, said proximate inner grip wall being of such a dimension that when said head end portion is plugged and gripped in said proximate inner grip wall, said central head contact and said peripheral head contact establish electrical connection with said tip contact and said proximate inner grip wall, respectively;

said illuminating tool further comprising:

a tool holding member having a lower grip portion that defines a second axis and that is of a dimension such that said distal socket portion is plugged and gripped in said lower grip portion, a collet portion disposed distal to said distal socket portion along said second axis and adapted to grip a tool therein, and an accommodation chamber interposed between said lower grip portion and said collet portion along said second axis so as to receive said electric bulb when said distal socket portion is gripped in said lower grip portion; and a ferrule member disposed to couple with said collet portion so as to tighten gripping action of said collet member on the tool.

2. The illuminating tool as defined in claim 1, wherein said tool holding member is made from a transparent plastic material.

3. The illuminating tool as defined in claim 1, wherein said collet portion defines an inner wall of hexagonal cross section, said illuminating tool further comprising a tool that defines a second axis parallel to said first axis and that has a shank portion extending in said second axis and of a cross section corresponding to said inner wall of said collet portion, and an enlarged magnetic head disposed on one end of said shank portion such that, when said shank portion is inserted into said collet portion, said enlarged magnetic head will be exposed exteriorly of said collet portion, and such that said shank portion will be gripped by tightening action of said ferrule member on said collet portion.

4. The illuminating tool as defined in claim 3, wherein said collet portion defines an inner wall of hexagonal cross section, said illuminating tool further comprising a tool that defines a second axis parallel to said first axis and that has a shank portion extending in said second axis and of a cross section corresponding to said inner wall of said collet portion, and a mirror mounted on an end of said shank portion and adjustable relative to said second axis such that when said shank portion is inserted into said collect portion, said mirror will be exposed exteriorly of said collet portion, and such that said shank portion will be gripped by tightening action of said ferrule member on said collet portion.

* * * * *